US008731228B2

(12) United States Patent
Burgett et al.

(10) Patent No.: US 8,731,228 B2
(45) Date of Patent: May 20, 2014

(54) EARPIECE SYSTEM

(75) Inventors: Seth Burgett, Glen Carbon, IL (US); Richard J. Daniels, St. Louis, MO (US); Melvin Joshua Leedle, St. Louis, MO (US)

(73) Assignee: Verto Medical Solutions, LLC, St. Louis, MO (US)

( * ) Notice: Subject to any disclaimer, the term of this patent is extended or adjusted under 35 U.S.C. 154(b) by 0 days.

(21) Appl. No.: 13/281,907

(22) Filed: Oct. 26, 2011

(65) Prior Publication Data

US 2012/0128192 A1 May 24, 2012

Related U.S. Application Data

(63) Continuation of application No. PCT/US2010/033197, filed on Apr. 30, 2010.

(60) Provisional application No. 61/174,305, filed on Apr. 30, 2009.

(51) Int. Cl.
*H04R 1/10* (2006.01)

(52) U.S. Cl.
USPC ..... 381/380; 381/370; 381/182; 181/135

(58) Field of Classification Search
USPC ..... 381/328, 380–381, 370; 181/135, 181/129–130
See application file for complete search history.

(56) References Cited

U.S. PATENT DOCUMENTS

| | | | | |
|---|---|---|---|---|
| 2,521,414 A | | 9/1950 | Schier | |
| 5,247,946 A | * | 9/1993 | Holder | 128/864 |
| D388,093 S | * | 12/1997 | Frengley | D14/223 |
| 6,122,388 A | * | 9/2000 | Feldman | 381/322 |
| 7,720,244 B2 | * | 5/2010 | Espersen et al. | 381/330 |
| 7,916,888 B2 | * | 3/2011 | Sapiejewski et al. | 381/382 |
| 8,194,911 B2 | * | 6/2012 | Dyer et al. | 381/382 |
| 2006/0067551 A1 | | 3/2006 | Cartwright et al. | 381/322 |
| 2006/0067556 A1 | * | 3/2006 | Bailey et al. | 381/380 |
| 2006/0291682 A1 | | 12/2006 | Urso et al. | 381/328 |
| 2009/0034775 A1 | * | 2/2009 | Burton | 381/380 |
| 2009/0214065 A1 | * | 8/2009 | Dahl | 381/328 |

FOREIGN PATENT DOCUMENTS

| | | | |
|---|---|---|---|
| JP | H02100390 | U | 8/1990 |
| JP | H07115695 | A | 5/1995 |
| JP | H1066181 | A | 3/1998 |
| JP | 2003-333679 | A | 11/2003 |
| JP | 2007-518355 | A | 7/2007 |
| JP | 2008-017473 | A | 1/2008 |
| WO | WO96/23443 | | 8/1996 |

OTHER PUBLICATIONS

European Supplemental Search Report, Dated: Mar. 14, 2013, Pages: 3.

* cited by examiner

*Primary Examiner* — Brian Ensey
*Assistant Examiner* — Sabrina Diaz
(74) *Attorney, Agent, or Firm* — Harness, Dickey & Pierce, P.L.C.

(57) ABSTRACT

An earbud adapter or in-ear monitor includes an Ear Interface that fits the human ear and further permits the wearer of these devices to adjust parameters of the fit. In additional aspects, the Ear Interface portion of these devices permits the user to adjust the transmission of ambient sound. The Ear Interface portion also allows the user to change ornamentation.

10 Claims, 17 Drawing Sheets

EARPIECE SYSTEM

CROSS-REFERENCE TO RELATED APPLICATIONS

This Utility Patent Application is a continuation of and claims priority to PCT/US2010/033197, filed Apr. 30, 2010, which claims priority to U.S. Provisional Application No. 61/174,305, filed Apr. 30, 2009, entitled: EAR INTERFACE, both disclosures of which are incorporated herein.

BACKGROUND

Portable music players and portable telephones are becoming increasingly common. Owners of these and similar devices often prefer to use them in conjunction with personal sound delivery devices, such as headphones or earbuds. These devices are worn, for example, while driving (e.g. telephone headset), exercising, traveling, studying, or the like.

Nearly all music players and portable phones have standard earbuds as an accessory, including standard Ear Interfaces that often do not stay in the user's ears or become uncomfortable over time or do a poor job of blocking ambient sounds.

A proper fitting Ear Interface can provide the benefit of ambient noise isolation or suppression similarly to how earplugs block sound. However, the Ear Interfaces of standard earbuds often do not fit well enough to accomplish this.

In an attempt to address the above described standard Ear Interface fit problems, some companies offer kits of different size earbud adapters. The user selects, through a process of trial and error, the earbud adapter with an Ear Interface that fits his ear the best. While the probability of a better fit is thus increased, it is still inadequate because the variation in human ear anatomy is too great to be accommodated with a kit of Ear Interfaces that is necessarily limited in its range of shapes and sizes. Furthermore, this approach requires the user to try on each earbud adapter and determine, sometimes over several hours use, if its Ear Interface provides the best fit. Finally, once the adapter with the optimal Ear Interface is selected, the remaining adapters are useless and this results in material waste.

Some companies provide an earbud adapter comprising a single flexible Ear Interface where the user is able to adjust its shape and size; an elastic material (typically some sort of foam) is compressed and inserted into the ear canal. The material then expands to conform to the inner surfaces of the user's ear canal anatomy. This flexibility or compliance partially addresses the above mentioned problems with kits, but the extent of the flexibility or compliance is necessarily limited to provide optimal results for a small range of anatomy centered on the average ear. When purchasing this product, the user will typically not know in advance whether his ears will fall within the range of the adapter's accommodation. If his ears fall outside that range, the resulting pressure will likely result in pain at locations known as pain points within the ear.

To solve the above mentioned problems, other companies supply full custom earbuds or earbud adapters. They do this by first injecting a soft material into the user's ear to form a physical impression or mold. The mold supplies the ear shape information that is then used to manufacture a full custom fitted Ear Interface portion of the earbud or earbud adapter. While this full custom approach would seem to solve the problems outlined above, there remains a number of inadequacies:

- A significant amount of skilled labor is required elevating, the production cost.

- Production costs are further increased because the full custom approach necessarily precludes mass production.
- The user must undergo the molding process which can be uncomfortable, scary, and time consuming.
- Also, the user must wait at least several business days while the full custom solution is built and shipped.
- The mold material, once injected into the ear, exerts a small pressure on the ear tissues as it solidifies. Some of the ear tissues are soft and are deformed by this pressure. The resulting custom ear adapter, when inserted into the ear, will therefore deform those ear tissues possibly leading to discomfort, especially when the adapter is in the ear for longer intervals.
- In the process of manufacturing the adapter based on information provided by the mold, the skilled technician must interpret the mold; the mold may have had bubbles on its surface or may show visual evidence, detectable to the expert eye, of not having been in contact with the ear while it was solidifying. The skilled technician must then modify the adapter accordingly.
- If the Ear Interface portion does not fit perfectly, a manual adjustment may be needed wherein a skilled technician erodes its shape, typically using a rotary grinder such as a Dremel tool, to relieve pressure on the known pain points within the ear such as the Crus of Helix, the Tragus, the Anti-Tragus and the Anti-Helix.

For these and other reasons, there is a need for the present invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

In accordance with aspects of the present invention, a mass produced semi-custom earbud adapter or mass produced semi-custom earbud monitor comprises an Ear Interface that fits the human ear and further permits the wearer of these devices to adjust parameters of the fit. In additional aspects, the Ear Interface portion of these devices permits the user to adjust the transmission of ambient sound. The Ear Interface portion also allows the user to change ornamentation.

Ear Interface herein means a portion of a personal sound delivery device or of an adapter thereto which firstly, physically contacts the human ear; secondly, affects a characteristic of said physical contact to the human ear; and thirdly, conducts sound into the human ear.

An earbud herein means a personal sound delivery device that fits substantially within the outer ear and which comprises an acoustic emitter. Most earbuds in common use today are standard, one-size-fits-all, earbuds and therefore, comprise a standard Ear Interface not having been fabricated according to the user's specific ear anatomy.

An in-ear monitor herein means an earbud wherein its Ear Interface is either custom or semi-custom fabricated to accommodate the user's specific ear anatomy.

An earbud adapter herein means a physical adapter that firstly, physically and acoustically connects to an earbud and; secondly, comprises an Ear Interface which physically and acoustically connects to the user's ear. An earbud adapter does not include an acoustic emitter.

An earpiece herein refers generically to either an earbud or an earbud adapter.

Figure 1B:
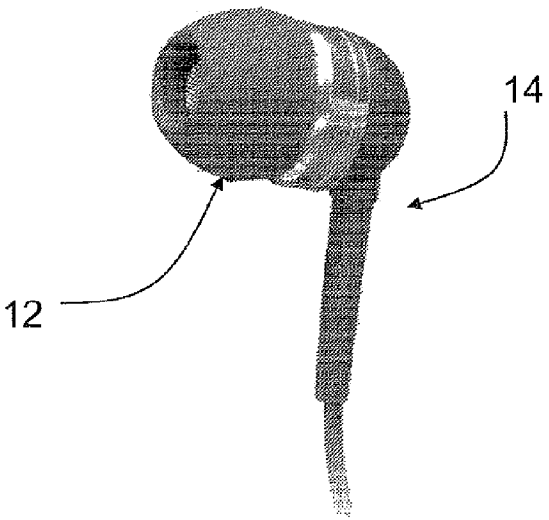
Figure 1b (Prior Art)
FIG. 1*b* illustrates a standard earbud comprising a standard Ear Interface made to go into the ear canal of the ear.
Figure 1A:
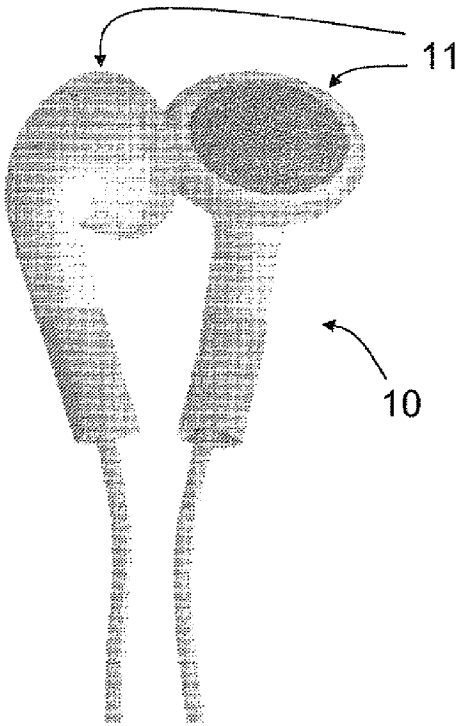
Figure 1a (Prior Art)
FIG. 1*a* illustrates a pair of standard earbuds each comprising a standard Ear Interface made to go into the Concha (bowl) of the ear.

Referring to FIG. 1*a*, a pair of prior art earbuds has an Ear Interface that is standard. Only one shape and size is available and so no attempt to accommodate varying ear anatomy is made. This earbud is made to fit into the Concha of the ear.

Other earbuds are made to fit into the ear canal (FIG. 1*b*). Most of these ear-canal type earbuds have an Ear Interface comprised of foam end pieces that the user compresses before inserting the earbud into the ear canal. Once inserted, as the foam expands, it conforms to the anatomy of the ear canal. The foam makes these Ear Interfaces adjustable and the product, as manufactured, does not vary from one customer to another.

Figure 1C:
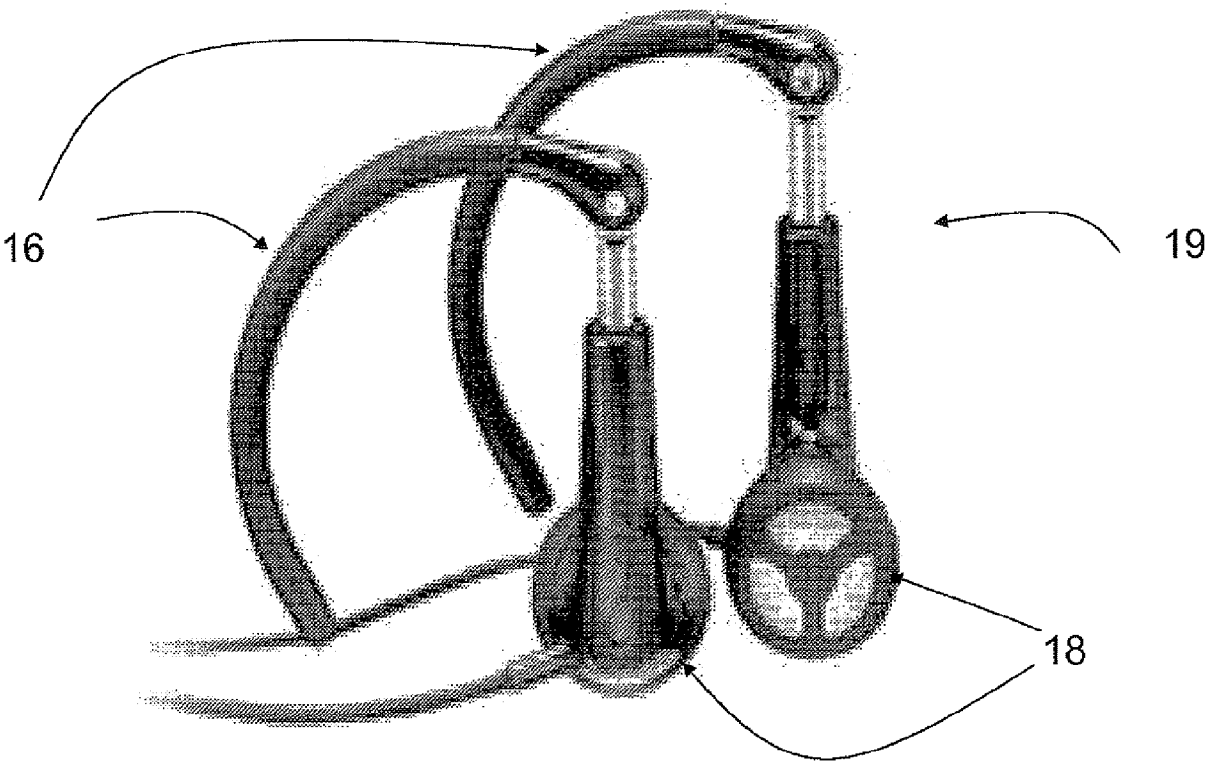
Figure 1c (Prior Art)
FIG. 1*c* illustrates a pair of standard earbuds comprising a standard Ear Interface made to go into the Concha (bowl) of the ear with loops made to go over the ears and prevent the earbuds from falling out of the ears.

FIG. 1*c* illustrates a pair of standard earbuds 19 each comprising a standard Ear Interface 18 made to go into the Concha (bowl) of the ear with loops 16 made to go over the ears and prevent the earbuds from falling out of the ears. A key failing of this device occurs when the earbud 18 separates from the ear canal region (reducing the intended sound from earbud from entering the ear canal while simultaneously increasing ambient noise transmission) as a result of movement of the device relative to the ear. This relative movement is frequently caused by sudden head movements; the device has non-zero mass and therefore, undergoes said relative motion caused first, by its inertia in the presence of head motion induced accelerations and; second, by the anchoring points along the loop which are not co-located with the Ear Interface 18.

Figure 2B:
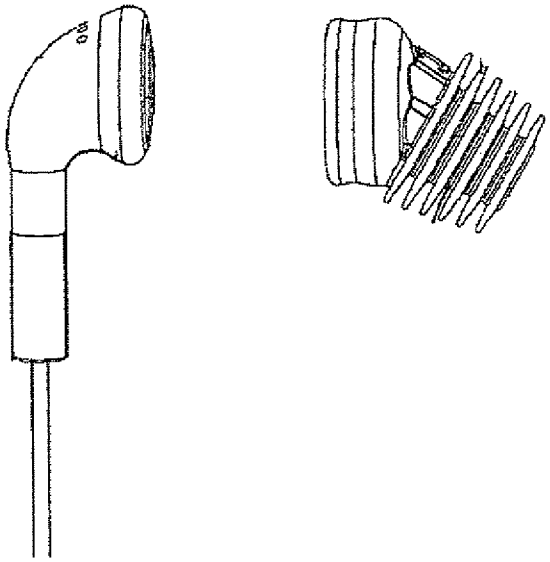
Figure 2b (Prior Art)
FIGS. 2*a* and 2*b* illustrate an after-market earbud adapter comprising a standard Ear Interface that is adjustable.
Figure 2A:
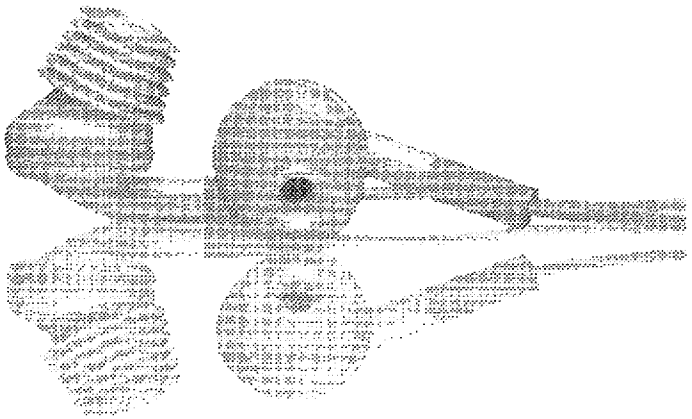
Figure 2a (Prior Art)

FIG. 2 shows a prior art earbud adapter made by Burton Technologies, LLC (the product name is Acoustibuds) that also has an adjustable Ear Interface. This earbud adapter is an in-canal type device and uses fins, rather than foam, to permit compression, insertion, and then conformal expansion. The adjustability of this device additionally allows the user to vary the angle between its earbud interface portion and the Ear Interface portion. Although Ear Interfaces of this type are adjustable the product, as manufactured, does not vary from one customer to another.

Figure 3B:
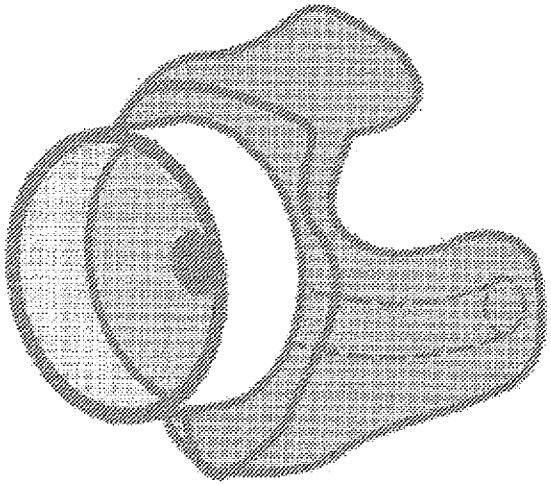
Figure 3b (Prior Art)
FIGS. 3*a* and 3*b* illustrate an after-market earbud adapter comprising a full customer Ear Interface.
Figure 3A:
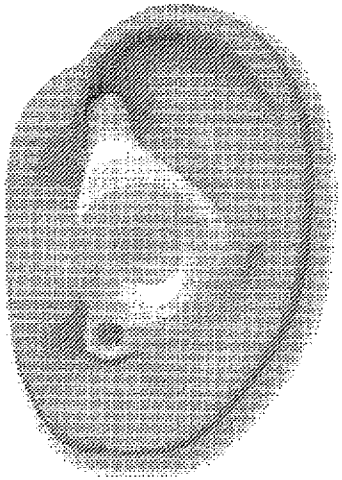
Figure 3a (Prior Art)
Figure 4B:
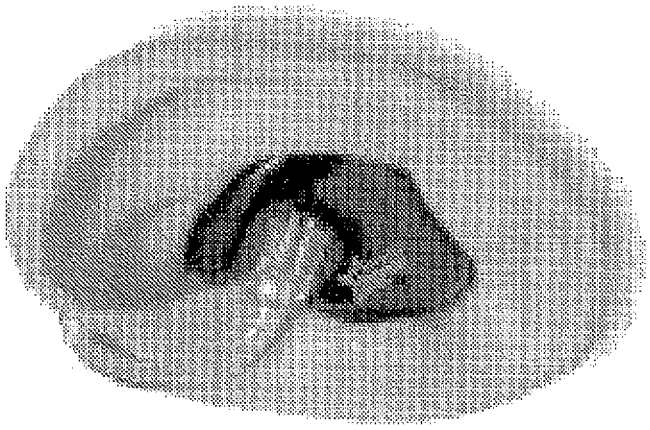
Figure 4b (Prior Art)
FIGS. 4*a* and 4*b* illustrate an after-market in-ear monitor comprising a full customer Ear Interface.
Figure 4A:
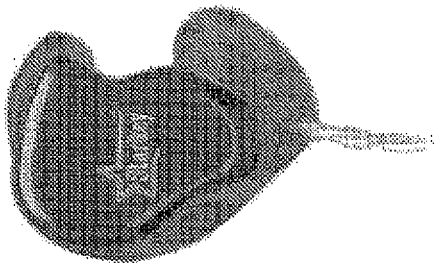
Figure 4a (Prior Art)

FIGS. 3*a* and 3*b* show a full custom earbud adapter made by Starkey Laboratories, while FIGS. 4*a* and 4*b* show a full custom in-ear monitor also made by Starkey Laboratories. The devices of FIGS. 3 and 4 are both fabricated using the molding process outlined hereinabove and are made to order. The adapter of FIG. 3 does not incorporate an acoustic driver while the in-ear monitor of FIG. 4 does incorporate the driver. Neither of these devices can be mass produced and both of them are expensive and time consuming to manufacture.

Figures 5A, 5B:
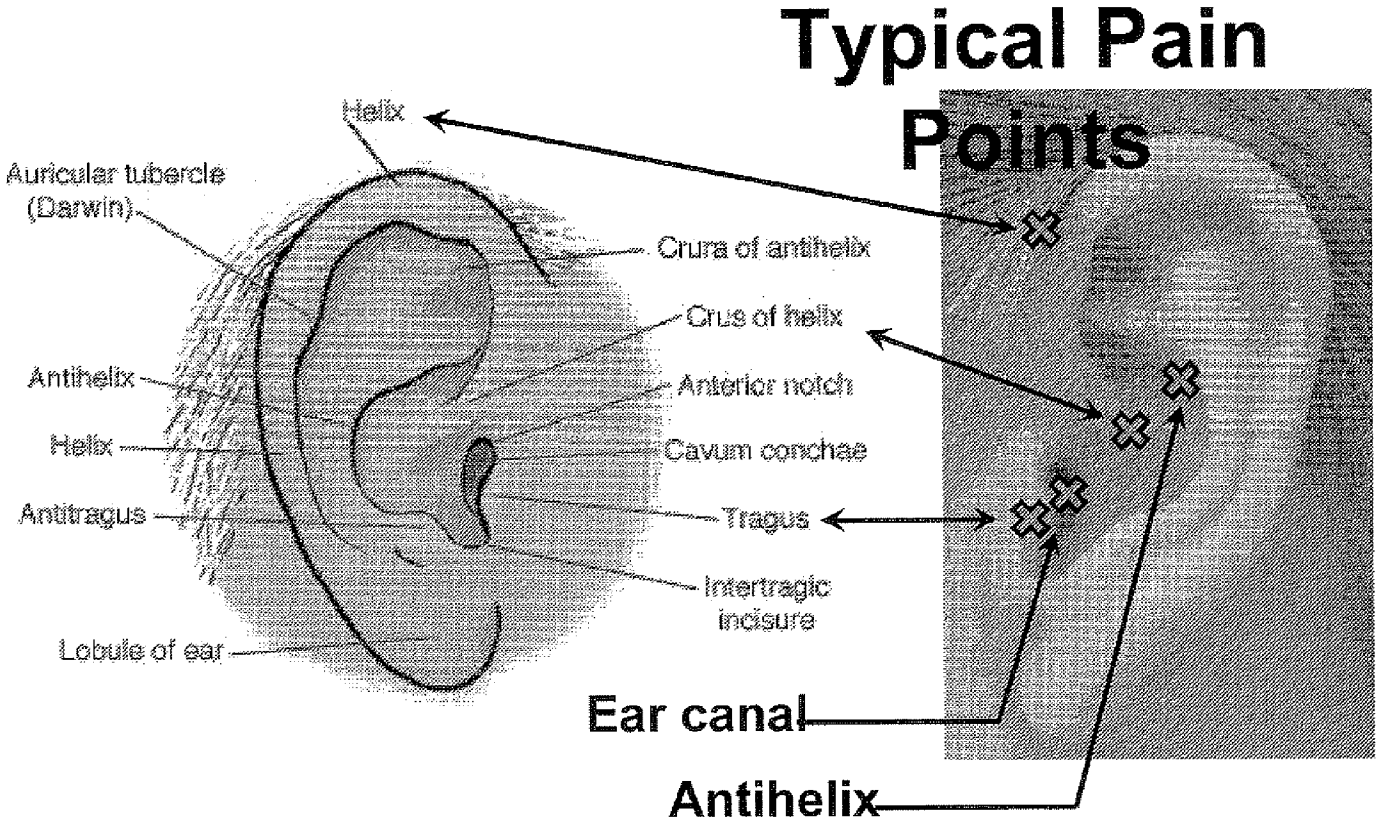
Figure 5b (Prior Art)
Figure 5a (Prior Art)
FIGS. 5*a* and 5*b* are maps of the outer ear anatomy with known pain points labeled.

FIGS. 5*a* and 5*b* are illustrations of a human ear. The features of particular interest are the Helix 10, Ear Canal 12, Crus of Helix 14 (the "Crus"), the Tragus 16 and the Anti-Helix 18. As illustrated in FIG. 5*b*, these are typical pain points. Devices worn in or on the ear that put pressure on these anatomical features are known to cause pain, especially when worn over longer times, for example, an hour or more.

Figure 5C:
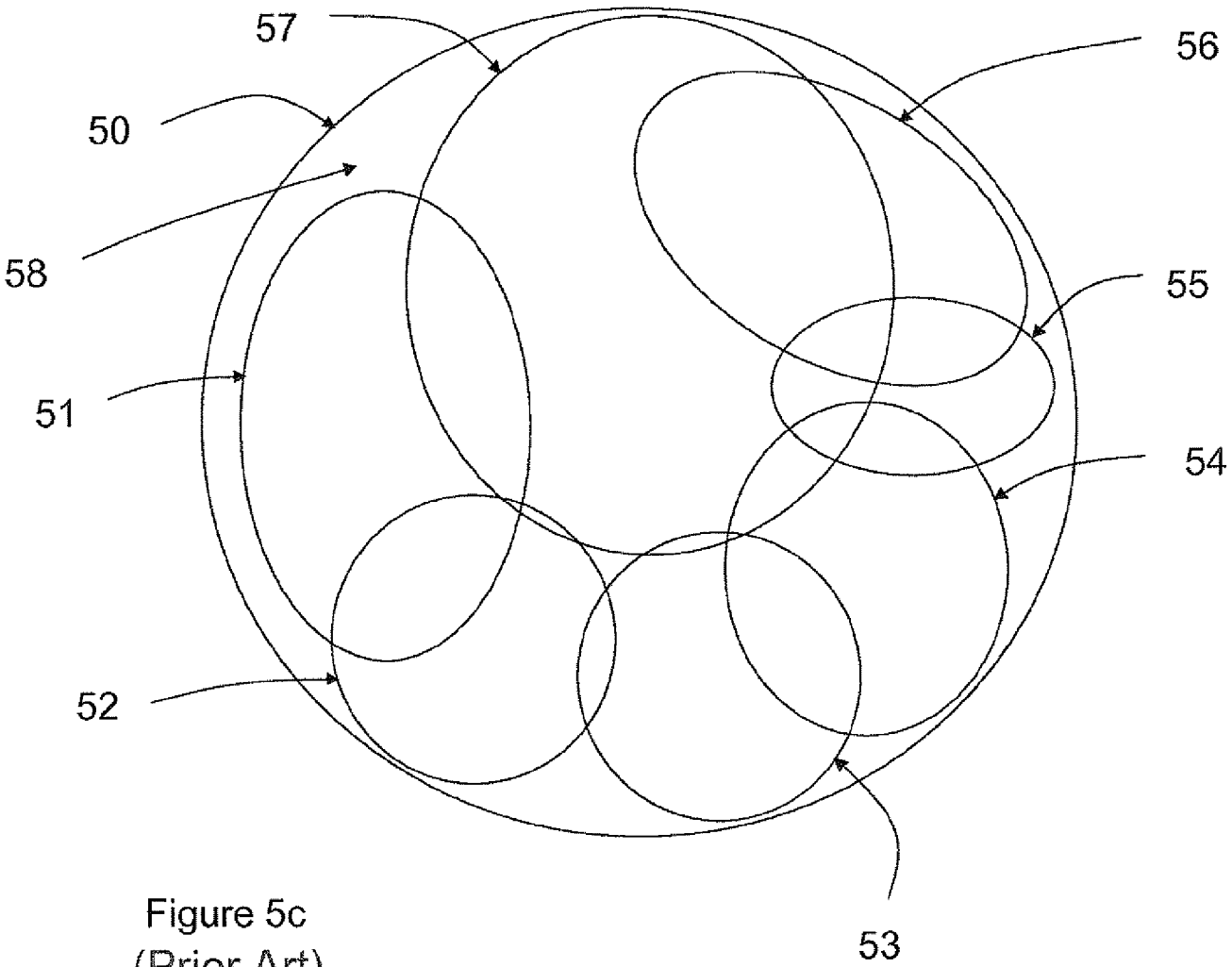
Figure 5c (Prior Art)
FIG. 5*c* is a Venn diagram illustrating how the entirety of ear anatomies spanning the world of possible customers is partitioned into Target Subsets.

Refer now to FIG. 5*c* which is a Venn diagram showing the world of possible ear anatomies partitioned into smaller, Target Subsets. Unlike devices with standard Ear Interfaces (which must accommodate the set of all ear anatomies 50) each instance of earbud adapter or in-ear monitor of this disclosure need only accommodate a subset (one of 51-57) of potential ear anatomies, herein called a Target Subset. Multiple variants of earbud adapters or in-ear monitors are mass produced on scales consistent with the market size of the variant's Target Subset. For example, since Target Subset 57 is larger than Target Subset 53, it would make economic sense to manufacture the earbud adapter or in-ear monitors that correspond to (optimized for) Target Subset 57 in higher volume than those that correspond to Target Subset 53. The ensemble of variant Ear Interface sizes and shapes are able to accommodate substantially all ear anatomies, however, there will be anatomies 58 that fall out of this ensemble.

The user chooses which of the several available sizes and shapes is optimal for him. This choice can be accomplished manually (by trying all of them on, for example), with some external assistance (by pre-filtering based upon a physical measure of the ear, for example), or automatically, for example as described in U.S. Provisional Patent Application 61/154,502 (incorporated by reference).

Because the embodiments of the earbud adapter or in-ear monitor of this disclosure need only accommodate its corresponding Target Subset rather than the entire range of anatomies, it can fit that Target Subset better while simultaneously being more comfortable. Fit, in this context, means that it will reliably stay in the ear and not fall out or wobble (even if the wearer is exercising vigorously) and form a good acoustic seal (to effectively block out ambient sound).

As stated above, embodiments of the earbud adapter or in-ear monitor of this disclosure will typically be mass manufactured, but it is also possible to accommodate those customers who wish to have a product with a unique color, pattern or electronics (in the case of in-ear monitor). To do this economically (in comparison to full-custom devices), the same manufacturing molds that are used for mass production of the required shape would be employed to make the required number of these custom devices, possibly only one of them. Thus, the costs of making a new mold or manually shaping an object are avoided, while the benefits of some customization are realized.

Figure 6:
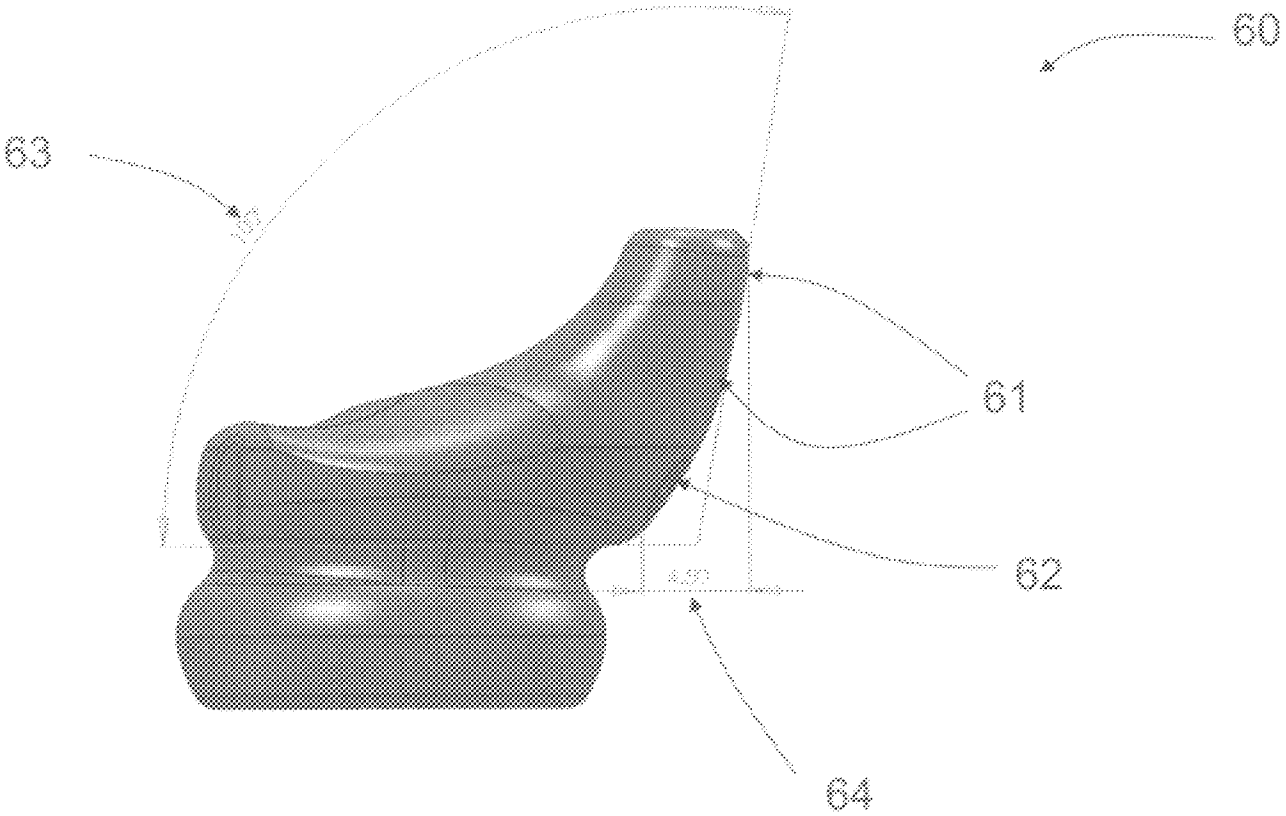
FIG. 6 illustrates a semi-custom earbud adapter shaped to minimize contact with the Tragus and with an ear canal portion shaped to make a less than 360° fit to the inner surface of the ear canal.

The inner surface of the ear canal is known to be sensitive to pressure, and devices inserted into this portion of the ear anatomy are prone to causing user discomfort. FIG. 6 is a side view of a semi-custom earbud adapter 60. The portion of this earbud adapter 61 that enters that ear canal has a diameter small enough so that portion 61 does not contact the inner surface of the ear canal over its entire circumference. Portion 61 has walls that are thin enough to permit portion 61 to flex easily. Thus, the pressure exerted by portion 61 on the inner surface of the ear canal is minimized, in turn minimizing user discomfort.

The Tragus is also known to be sensitive to pressure, and devices that contact this portion of the ear anatomy are prone to causing user discomfort. Angle 63, dimension 64, and shape of surface portion 62 are optimized so as to minimize contact with the Tragus of the ear (for the Target Subset corresponding to any particular variant of earbud adapter or in-ear monitor), thereby minimizing user discomfort. In the illustrated embodiment, the angle 63 is about 100 degrees and the dimension 64 is about 4.50 mm.

Figure 7B:
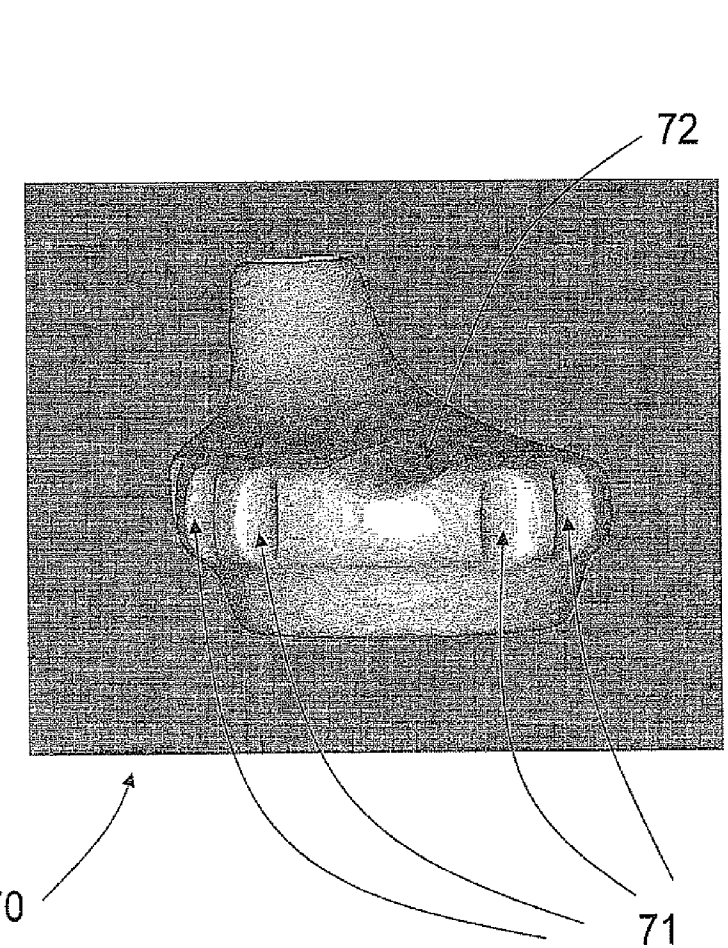
FIGS. 7*a* and 7*b* illustrates a semi-custom earbud for Concha type earbuds and comprising a landing tailored for the posterior region of the Concha, Crus Relief and traction features.
Figure 7A:
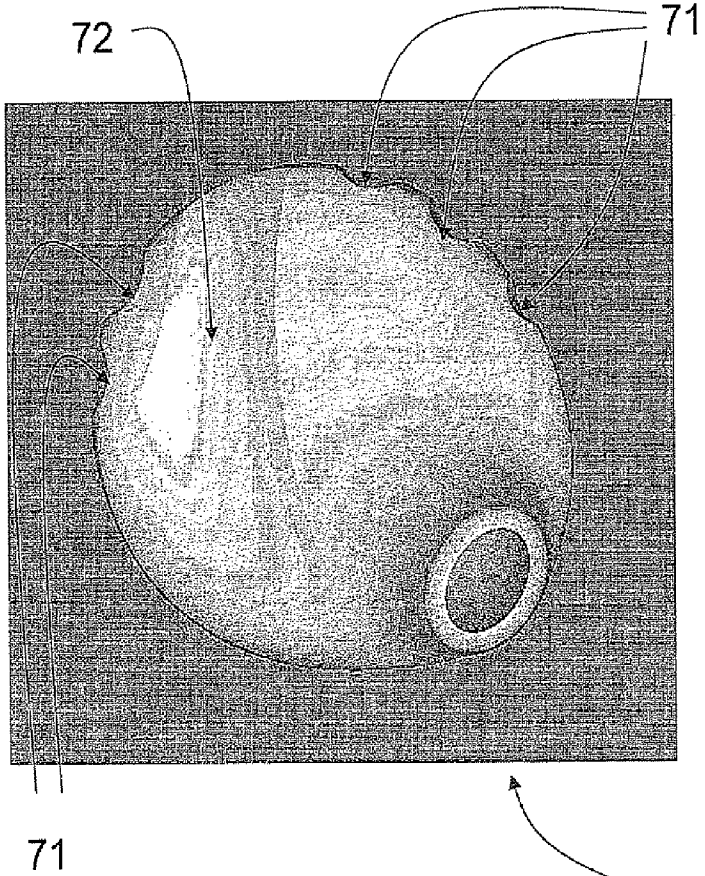
Figure 8:
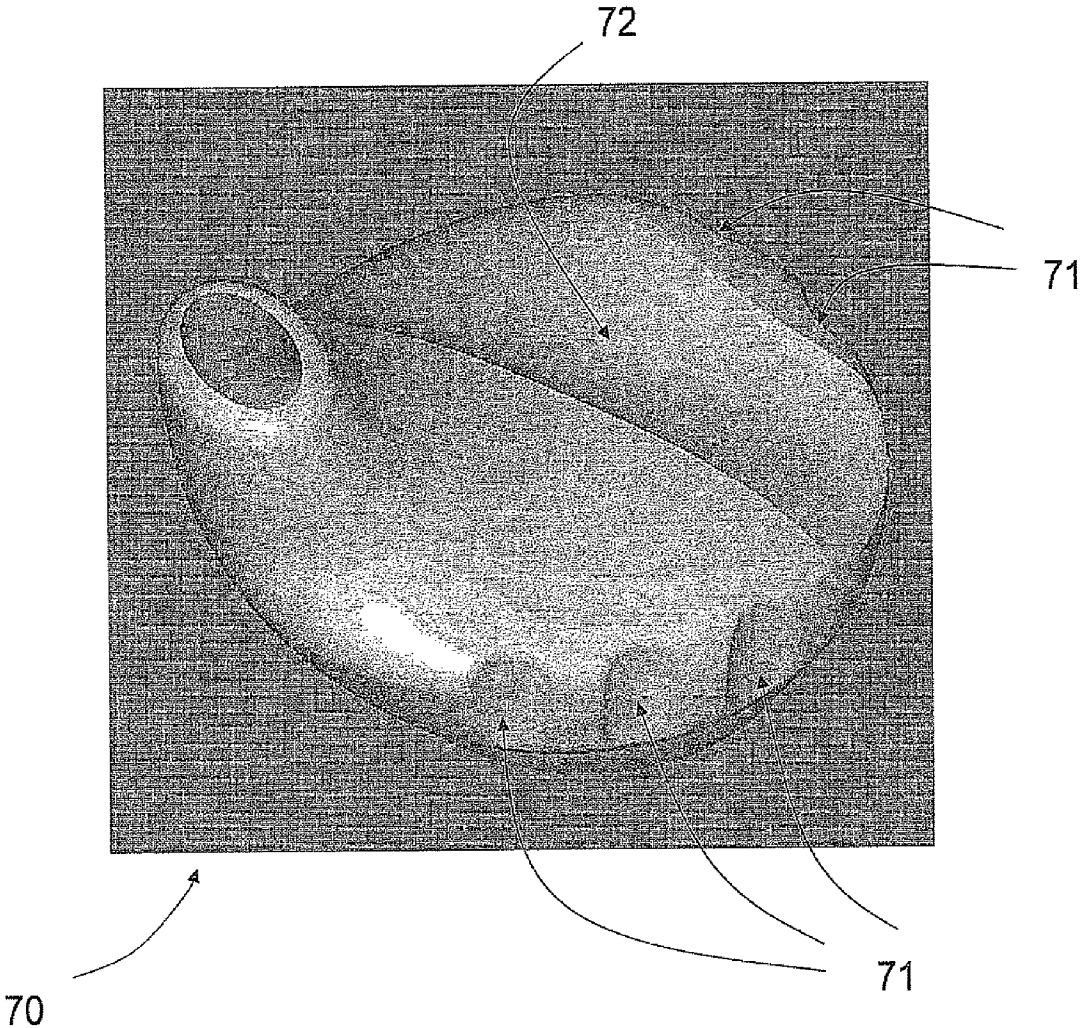
FIG. 8 is a perspective view of a semi-custom earbud adapter designed for Concha type earbuds and comprising a landing tailored for the posterior region of the Concha, Crus Relief and traction features.

The Crus is also known to be sensitive to pressure, and devices that press on this portion of the ear anatomy are prone to causing user discomfort. Refer now to FIGS. 7*a*, 7*b*, and 8 which are three views of an embodiment of an earbud adapter 70 of this disclosure. Earbud adapter 70 has traction features 71 and Crus Relief 72. Crus Relief 72 is a concave feature in a major surface on some embodiments of the earpieces (earbud adapters and/or in-ear monitors) of this disclosure that prevents or reduces pressure exerted on the Crus, in turn minimizing user discomfort. Portion 72 has walls that are thin enough to permit portion 72 to flex easily. Thus, the pressure exerted by portion 72 on the Crus of the ear canal is minimized, in turn minimizing user discomfort. The Crus Relief 72 extends down the major surface illustrated in FIG. 7*a* and is generally shaped to accommodate the Crus of the ear canal.

The traction features 71 is not situated about the entire periphery of the earbud adapter 70. Traction features 71 of earbud adapter 70 or in-ear monitors (not illustrated) help to securely attach the earpiece to the posterior region of the Concha behind the Anti-Helix, an anatomical region known to have reduced sensitivity to pressure. In the illustrated embodiment, the traction features 71 are in the form of grooves or notches formed in a central portion of the earbud 70, and are situated generally transversely to the surface that defines the Crus Relief 72. The traction features 71 includes first and second groups that are situated on opposite sides of the Crus Relief 72. Traction features 71 are designed to help the device stay in the ear, even when the head is undergoing accelerations, for example, during exercise. The combination of the above mentioned Ear Interface attributes of in-canal portion 61, Tragus contact minimization attributes of surface portion 62 and Crus Relief 72 permit an earbud adapter or in-ear monitor, in accordance with aspects of this disclosure to be worn comfortably for hours by users whose anatomies fall into the variant's corresponding Target Subset. The Ear Interface traction features 71 assure that earbud adapter 70 or in-ear monitor (not illustrated) will stay in the user's ear without causing discomfort, even if the user is active, for example, when running.

Figure 9:
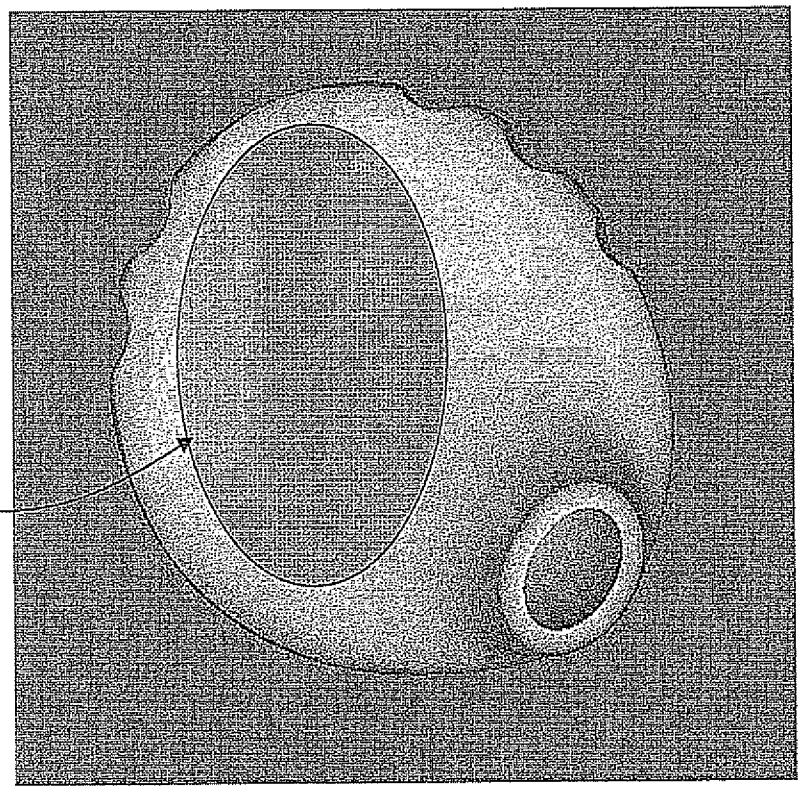
FIG. 9 illustrates a semi-custom earbud adapter with foam to relieve pressure on the Crus.

Refer now to FIG. 9, which illustrates an alternative and/or complimentary way used in some embodiments to avoid placing excessive pressure on the Crus. The area of earbud adapter 70 corresponding to Crus Relief 72 is, in illustration, covered with compression foam material 90. Thus, the earbud adapter 70 of FIG. 9 or a similarly constructed in-ear monitor (not illustrated), gains stability from the area of the Crus with minimum pressure and therefore, without causing discomfort.

The use of foam to contact the Crus does not necessarily preclude the use of the Crus Relief. The two can be used separately or in combination.

It is envisioned that a larger surface, extending beyond the region of the Crus, of the Ear Interface portion of the earbud adapter or in-ear monitor of this disclosure can be covered with such compression foam. This larger contact region allows increased stability and improved ability to stay in the ear while remaining comfortable.

Figure 10:
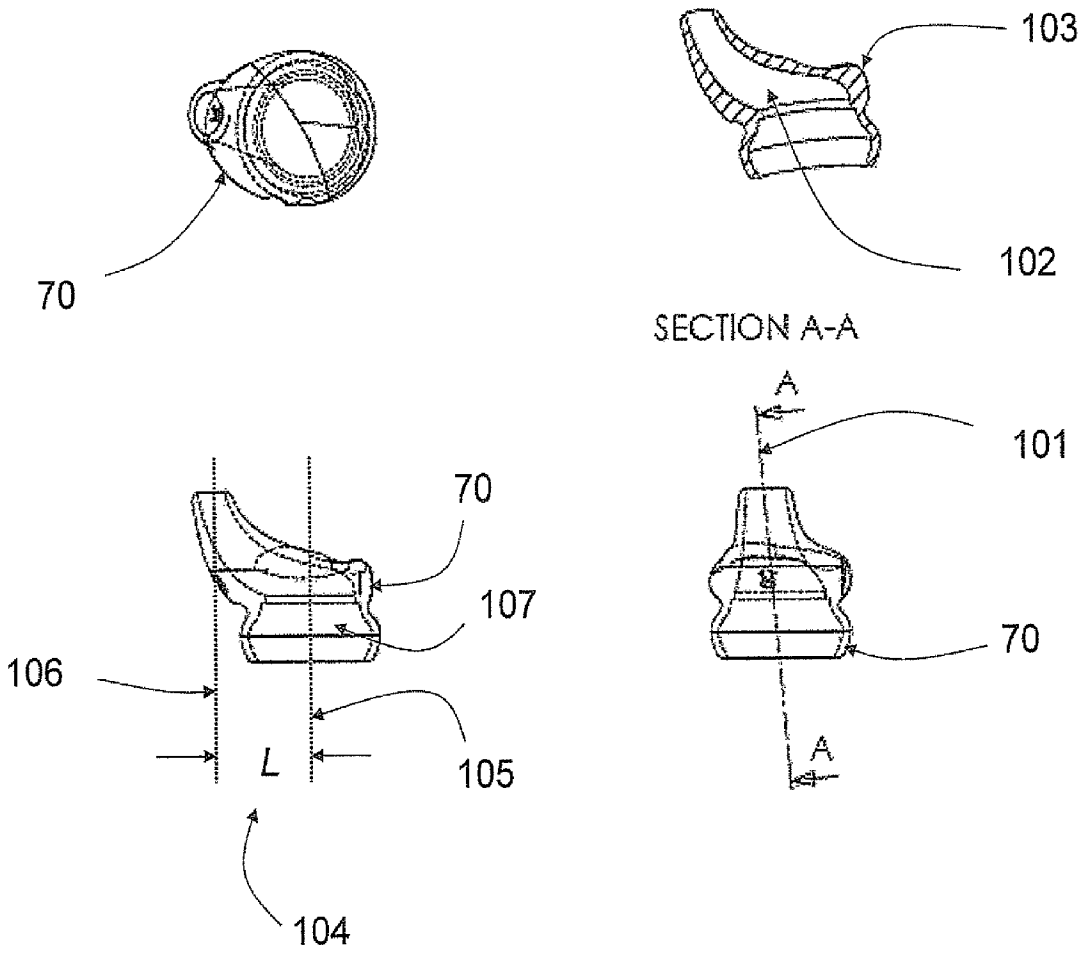
FIG. 10 illustrates a semi-custom earbud adapter designed for Concha type earbuds, including a section of the sound tunnel.

Refer now to FIG. 10, where a section view 103 along line A-A 101 illustrates the sound tunnel 102 of an embodiment of an earpiece, such as the earbud adapter 70. The first portion of the earbud adapter 70 is constructed to receive an earbud (not illustrated) into an earbud receiver chamber 107. The first portion has a major surface (see FIG. 7*a*) that, in some embodiments, defines the Crus Relief 72, which is generally a concave depression in the first surface shaped to accommodate the Crus of the ear. A second portion extends from the first portion and defines a sound tunnel 102 with an opening at the end thereof.

The first portion of the earpiece (earbud receiver chamber 107) has a first central axis or lateral position 105. The second portion of the earbud adapter 70 that defines the sound tunnel 102 is constructed to deliver sound to the ear canal through an opening with a second central axis or lateral position 106. The first and second central axes or lateral positions 105, 106 are offset from one another, such that the sound tunnel 102 is operative to laterally displace sound energy a distance L 104 so that the earbud (not illustrated), when mated to the earbud adapter 70 and inserted into an ear, will be positioned posterior to the ear canal. Positioning the earbud posterior to the ear canal, moves it away from the Tragus.

Thus, not only is the earbud adapter 70 of this disclosure constructed to minimize contact with sensitive ear anatomy, it also positions earbuds (not illustrated) and/or the wires leading to them to avoid discomfort.

Although FIG. 10 illustrates only one linear displacement 104, the sound tunnel 102 and earbud adapter 70 may be constructed to locate the earbud in any position or angle in order to prevent earbud contact to sensitive ear anatomy, such positions being limited by the requirements for good sound fidelity, mechanical stability, user comfort, and visual appearance.

The sound tunnel 102 of earbud adapter 70 may be fabricated of material different than the Ear Interface portion of the earbud adapter, such material being selected to improve the fidelity of sound delivered to the user's ear. Similarly, the shape of the sound tunnel 102 is preferably optimized to deliver high fidelity sound to the ear.

Figure 11:
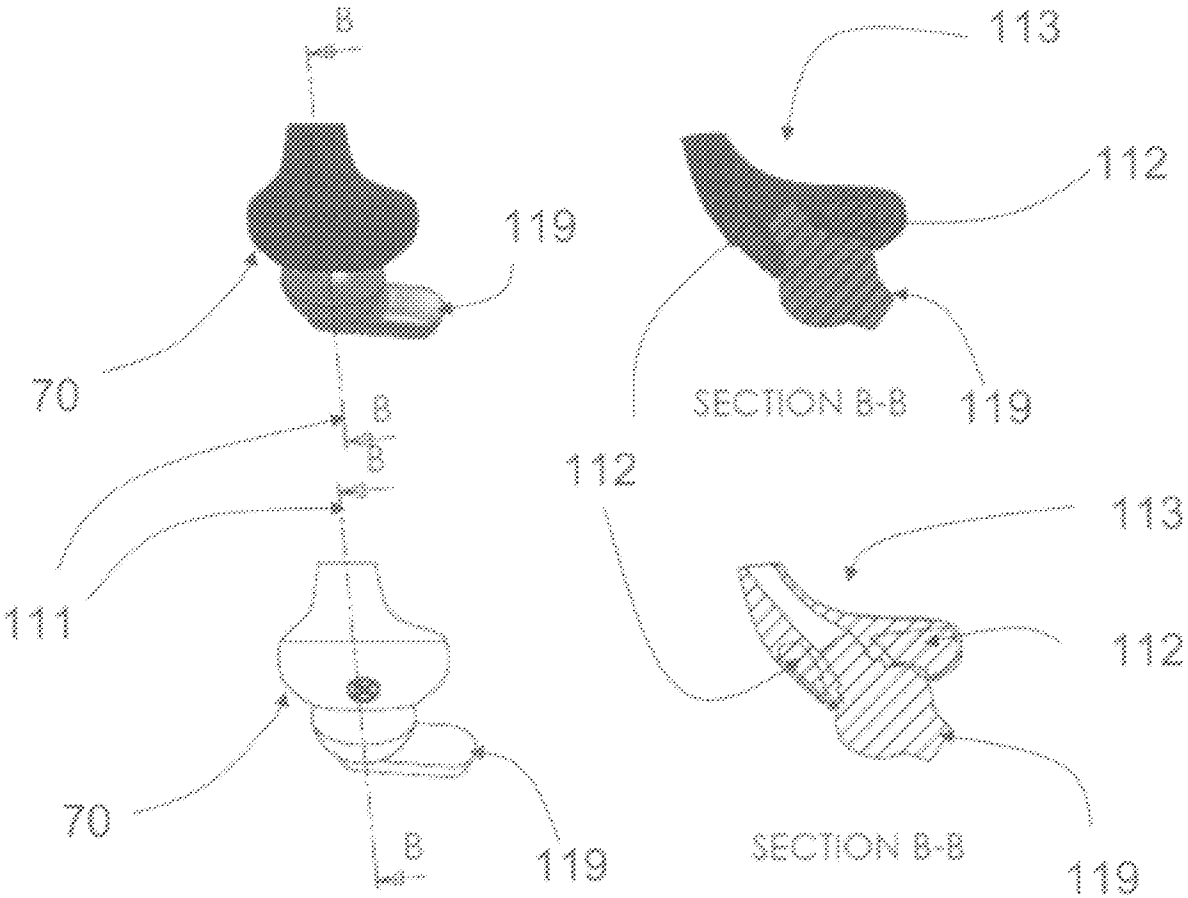
FIG. 11 illustrates a semi-custom earbud adapter designed for canal type earbuds, with the earbud installed into the adapter and section views.

Refer now to FIG. 11, where section views 113 along line B-B 111 illustrate compliance chamber 112 of earbud adapter 70. An earbud 119 is illustrated installed into earbud adapter 70.

The compliance chamber 112 is operative to adjust several aspects of the earbud adapter 70. First, the earbud adapter's acoustic transfer function (from the earbud to the ear) is affected by the mechanical parameters of the compliance chamber 112, such as its size, shape, surface material, and also of any filler material. Therefore, filling the compliance chamber with varying materials will change this transfer function. Second, because the wall separating the compliance chamber 112 from the surface that comes in contact with the ear is thin and to some degree flexible, stiffer or softer filler materials will change the deformability of that wall. Changing this deformability will change the way the Ear Interface fit the ear, which will affect comfort and the amount of ambient sound suppression.

Figures 12A, 12B:
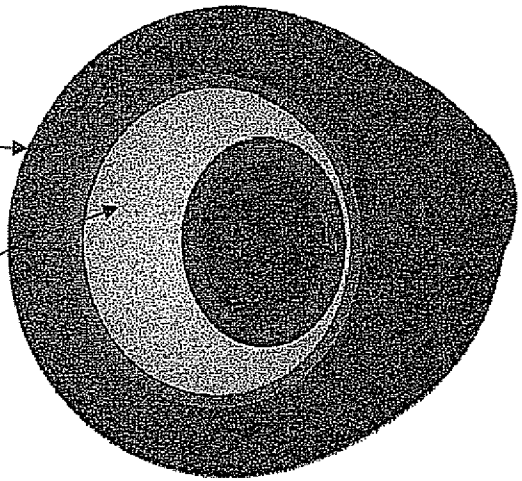
FIGS. 12*a* and 12*b* are perspective views of a semi-custom earbud adapter for canal type earbuds, with a material installed in the adapter's compliance chambers.

Referring now to FIGS. 12*a* and 12*b*, the compliance chamber 112 is shown filled with an elastic material 121. The user can select from an assortment of materials designed to fit into compliance chamber 112, such assortment allowing the user to adjust the acoustic transfer function or the compliance of the chamber independently of each other.

Thus, the user can adjust the subjective quality of fit including the comfort and the feeling of fullness that some users experience (and usually dislike) when devices are worn in the ear.

Additionally, the user can thus affect the tendency of the device to stay in the ear, including its stability while exercising.

Additionally, the user can thus affect the amount of ambient sound suppression (controlled by earbud adapter's seal to the ear anatomy, which is in turn affected by the compliance chamber's compliance).

When ambient sound is effectively suppressed, users will prefer to operate their earbuds or in-ear monitors at lower volumes, as there is a reduced need to compete with extraneous noise. Lowering this volume has two benefits; first, the user's ears are exposed to reduced sound pressure which may reduce sound induced injury to the ears and; second, the electrical power used to deliver the signal to the earbuds or in-ear monitors is reduced. This reduction of electrical power is beneficial, because the battery life in the portable music player or portable telephone is thereby extended.

Figure 12C:
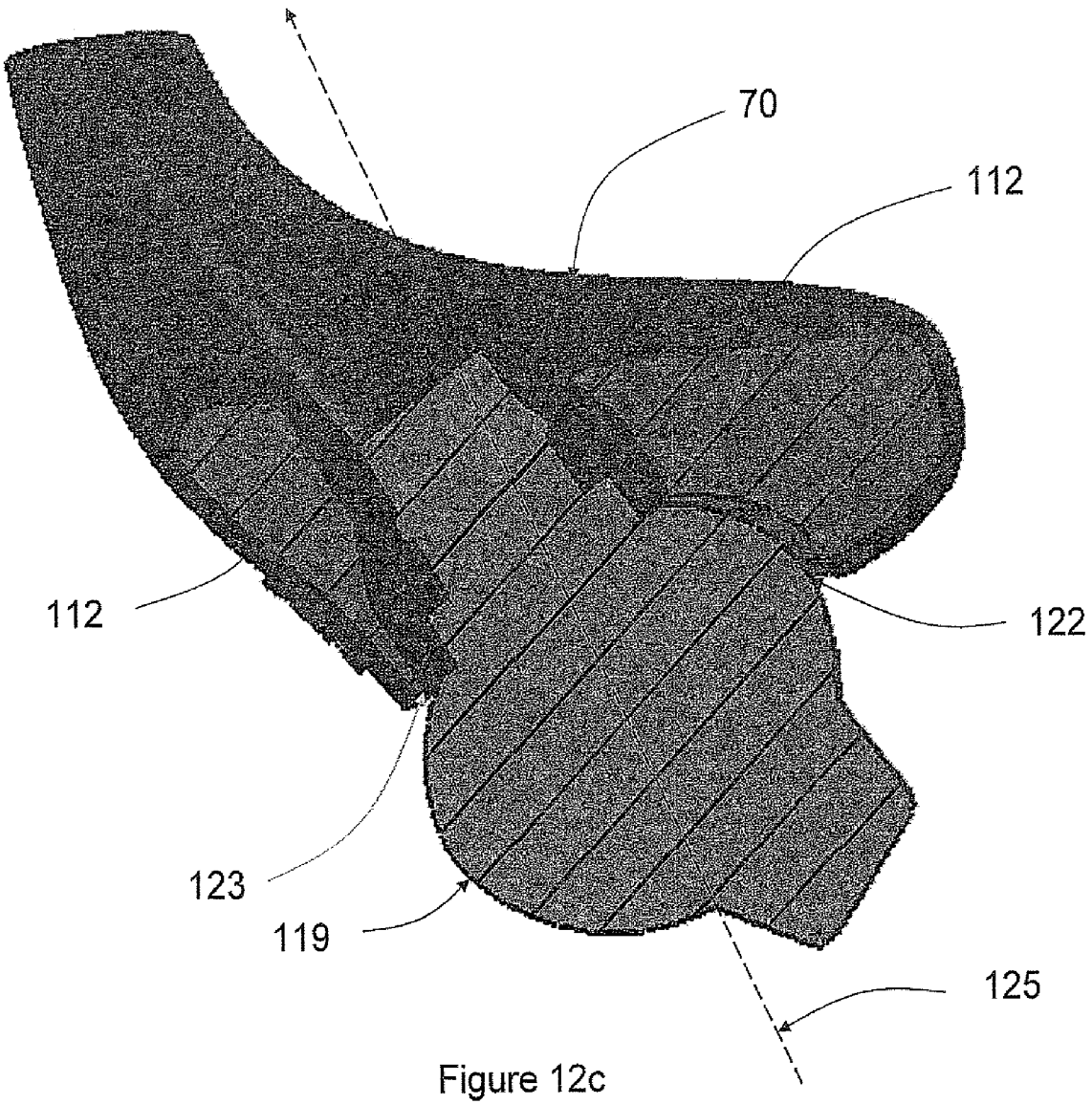
FIG. 12*c* is a sectional view of a semi-custom earbud adapter for canal type earbuds, with no material installed in the adapter's compliance chambers.

Referring to FIG. 12*c*, material in the compliance chamber can extend outside of the overall assembly through a gap 122 in the joint between earbud adapter 70 and earbud 119 and gap 123 in two surfaces of the earbud adapter 112. Although gaps 122 and 123 are illustrated in FIG. 12*c* as being discrete points, the earbud adapter would preferably, although not necessarily, be constructed so that the gap is continuous and extends through 360° of rotation about axis 125. This feature would also help eliminate the wobbling of the device which can be felt and heard hitting the Anti-Tragus and Tragus. It can also be useful in keeping the earbud from contacting the ear, thus avoiding said contact induced noise.

Thus, varying colors or designs can protrude from compliance chamber 112 and become visible, permitting the user to adjust the appearance of the assembly. Such variations might include business logos or images of school mascots or the like. The material that protrudes from compliance chamber 112 can be formed so that it extends in any direction. For example, it can fold back to cover portions of the earbud adapter 70. Or it could extend substantially outwards to cover earbud 119 or to cover all or part of the ear. Thus, the user is able to personalize the appearance of the overall assembly.

Although FIGS. 11 and 12 illustrate compliance chamber 112 in the context of an earbud adapter, it is envisioned that a similar compliance chamber can be operative to provide all of the above described functions for an in-ear monitor, which integrates electronics and an acoustic emitter. The chamber (not illustrated) enclosing such electronics and emitter would preferably be formed from a hard material, such as Lucite, to provide the best acoustic performance.

Figure 13:
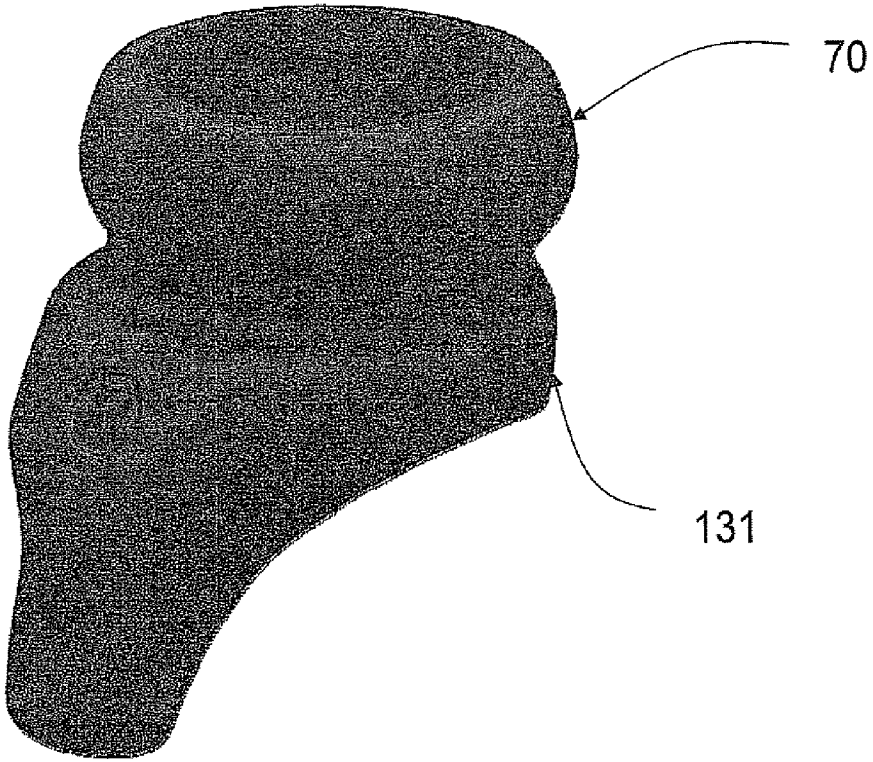
FIG. 13 illustrates a semi-custom earbud adapter where the Concha portion of the earbud adapter is smaller in diameter than a Concha type earbud and where traction features improve the stay-in power of the adapter.

Refer now to FIG. 13, where an earbud adapter 70 is operative to allow a user to comfortably wear an earbud (not illustrated), where the earbud's diameter is greater than the diameter of the user's Concha. The diameter of the earbud adapter that fits into the user's Concha is reduced, for example, by removing material from the earbud at location 131, but it is possible to achieve this goal in a variety of ways.

Figure 14:
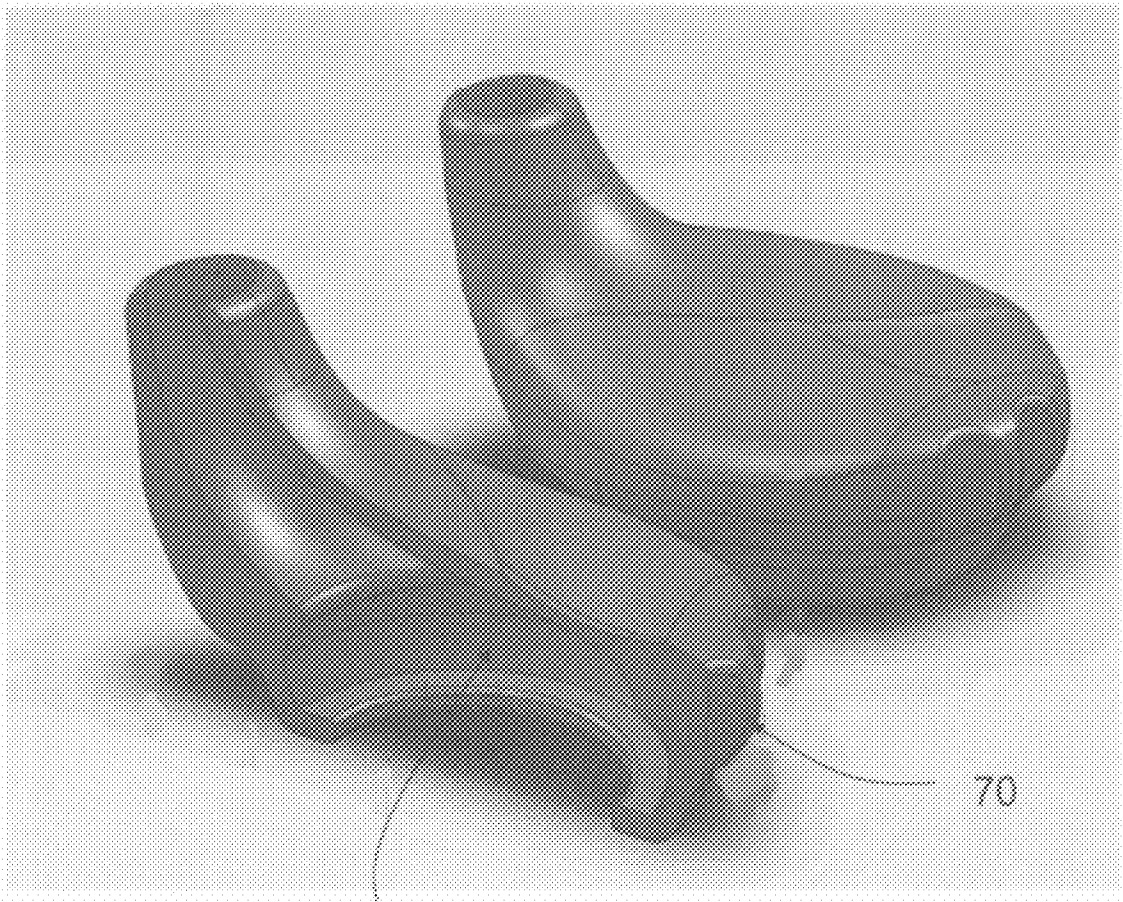
FIG. 14 is a section view of a Concha type earbud adapter that illustrates its earbud received chamber.

Refer now to FIG. 14, where earbud adapter 70 is presented in a section view to better view aspects of the earbud receiver chamber 107, which is designed to receive either an Apple iPod style earbud (not illustrated) or a Motorola Cell Phone headset without additional components or adjustments.

The earbud adapter of this disclosure is operative to prevent damage to earbuds by preventing human perspiration from reaching the earbud, including particularly, its acoustic and electronics components.

The earbud adapter and in-ear monitor of this disclosure allows the user to insert it into the ear using only one hand, as opposed to the two hands required to insert a full custom ear adapter or an adapter based on a compliant portion both of which are made to be inserted into the ear canal.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore it is intended that this invention be limited only by the claims and the equivalents thereof.

What is claimed is:

1. An ear interface for an ear phone, which physically engages with and acoustically connects to a user's ear, the ear interface comprising:

a hollow, flexible body that is adapted to fit in the concha of the user's ear, the body having a generally oval perimeter that generally corresponds to the perimeter of the concha, the body further having a smooth, generally flat oval contact face adapted to overlie the surface of the concha of the user's ear, the contact face having an elongate crus relief groove extending transversely across it for accommodating the crus of helix of the user's ear;

a first portion of the perimeter of the body being adapted to fit under the tragus and an adjacent second portion of the perimeter of the body being adapted to fit under the antitragus when the body is engaged in the concha;

a tube projecting from the generally flat oval contact face adjacent one end, and adapted to extend into the user's ear canal, the tube having a circumference less than the circumference of the ear canal so that the tube does not contact the surface of the ear canal around its entire circumference, the perimeter of the hollow, flexible body being generally smooth, with at least one of a first plurality of recesses in the perimeter of the hollow, flexible body, generally opposite from the tube, defining a plurality of raised traction features for engaging the wall of the concha, and a second plurality of recesses in the second portion of the perimeter of the hollow, flexible body, defining a plurality of raised traction features for engaging the wall of the concha of the user's ear below the antitragus, wherein the first plurality of recesses and the second plurality of recesses are situated on opposite sides of the elongate crus relief groove.

2. The ear interface according to claim 1 wherein the tube projects from the contact face at an angle of about 100°.

3. The ear interface according to claim 1 wherein the crus relief groove narrows in width from one side of the contact face to the other.

4. The ear interface according to claim 1 wherein the crus relief groove has a thinner wall thickness than the remainder of the contact face.

5. An earphone for connection to audio source, the earphone comprising:

a speaker and an ear interface for physically engaging with and acoustically connecting to a user's ear, the interface comprising a hollow, flexible body that is adapted to fit in the concha of the user's ear, the body having a generally oval perimeter that generally corresponds to the perimeter of the concha, the body further having a smooth, generally flat oval contact face adapted to overlie the surface of the concha of the user's ear, the contact face having an elongate crus relief groove extending transversely across it for accommodating the crus of helix of the user's ear;

a first portion of the perimeter of the body being adapted to fit under the tragus and an adjacent second portion of the perimeter of the body being adapted to fit under the antitragus when the body is engaged in the concha;

a tube projecting from the generally flat oval contact face adjacent one end, and adapted to extend into the user's ear canal, the tube having a circumference less than the circumference of the ear canal so that the tube does not contact the surface of the ear canal around its entire circumference;

the perimeter of the hollow, flexible body being generally smooth, with at least one of a first plurality of recesses in the perimeter of the hollow, flexible body, generally opposite from the tube, defining a plurality of raised traction features for engaging the wall of the concha, and a second plurality of recesses in the second portion of the perimeter of the hollow, flexible body, defining a plurality of raised traction features for engaging the wall of the concha of the user's ear below the antitragus, wherein the first plurality of recesses and the second plurality of recesses are situated on opposite sides of the elongate crus relief groove.

6. The earphone according to claim 5 wherein the tube of the ear interface projects from the contact face at an angle of about 100°.

7. The earphone according to claim 5 wherein the elongate crus relief groove of the ear interface narrows in width from one side of the contact face to the other.

8. The earphone according to claim 5 wherein the elongate crus relief groove of the interface has a thinner wall thickness than the remainder of the contact face.

9. An ear interface for an ear phone, which physically engages with and acoustically connects to a user's ear, the ear interface comprising:

a hollow, flexible body that is adapted to fit in the concha of the user's ear, the body having a generally smooth, oval perimeter that generally corresponds to the perimeter of the concha, the body further having a smooth, generally flat oval contact face adapted to overlie the surface of the concha of the user's ear, the contact face having an elongate crus relief groove extending transversely across it for accommodating the crus of helix of the user's ear, the elongate crus relief groove narrowing in width from one side of the contact face to the other;

a first portion of the perimeter of the body being adapted to fit under the tragus when the body is engaged in the concha, and an adjacent second portion of the perimeter of the body being adapted to fit under the antitragus when the body is engaged in the concha, a first plurality of recesses in the second portion of the perimeter, defining a plurality of raised traction features for engaging the wall of the concha of the user's ear below the antitragus;

a tube projecting from the generally flat oval contact face adjacent one end, at an angle of about 100°, the tube adapted to extend into the user's ear canal, the tube having a circumference less than the circumference of the ear canal so that the tube does not contact the surface of the ear canal around its entire circumference;

a first plurality of recesses in the perimeter of the body, generally opposite from the tube, defining a plurality of raised traction features for engaging the wall of the concha, wherein the first and second plurality of recesses are situated transversely to the contact face having the elongate crus relief groove.

10. The ear interface according to claim 9 wherein the elongate crus relief groove has a thinner wall thickness than the remainder of the contact face.

* * * * *